United States Patent [19]

Ueno et al.

[11] Patent Number: 4,919,553

[45] Date of Patent: Apr. 24, 1990

[54] PRINTER HAVING HEAD RELEASE MECHANISM RESPONSIVE TO SPACE COMMANDING CODES

[75] Inventors: Hideo Ueno, Nagoya; Satoshi Shibata; Keiko Yamada, both of Aichi, all of Japan

[73] Assignee: Brother Kogyo Kabushiki Kaisha, Japan

[21] Appl. No.: 194,279

[22] Filed: May 16, 1988

[30] Foreign Application Priority Data

May 19, 1987 [JP] Japan ..... 62-122223

[51] Int. Cl.[5] ..... B41J 3/20

[52] U.S. Cl. ..... 400/120; 346/76 PH; 400/321

[58] Field of Search ..... 400/320, 321, 322, 328, 400/120; 346/76 PH

[56] References Cited

U.S. PATENT DOCUMENTS 4,590,486 5/1986 Yana ..... 346/76 PH
4,709,242 11/1987 Uchikata et al. ..... 346/76 PH

FOREIGN PATENT DOCUMENTS 97816 1/1984 European Pat. Off. ..... 400/321
62184 5/1981 Japan ..... 346/76 PH
67472 4/1983 Japan ..... 346/76 PH
171982 10/1983 Japan ..... 400/321

*Primary Examiner*—David A. Wiecking
*Attorney, Agent, or Firm*—Oliff & Berridge

[57] ABSTRACT

A printer wherein a print head is movable by a head release mechanism, between a printing position and a release position, and a print ribbon is fed only when the print head is in the printing position. The printer has a space commanding member such as a space key adapted to feed the print head to provide a single space, when the space commanding member is momentarily operated, and feed the print head continuously to provide successive spaces while the space commanding member is held operated. The printer has a head-release control device which inhibits the head release mechanism from operating to move the print head to the release position if the space commanding member is momentarily operated, and activates the head release mechanism to move the print head to the release position if the space commanding member is operated continuously.

4 Claims, 8 Drawing Sheets

SP INDICATES SELF-REPEAT SPACE CODES PRODUCED BY CONTINUOUSLY PRESSING SPACE KEY

PRINTER HAVING HEAD RELEASE MECHANISM RESPONSIVE TO SPACE COMMANDING CODES

BACKGROUND OF THE INVENTION

1. Field of the Invention

The present invention relates to a printing apparatus using a print ribbon, and more particularly to a printing apparatus wherein printing is effected with a print head moved in pressed contact with a print ribbon.

2. Discussion of the Prior Art

An example of a printing apparatus of the type indicated above is a typewriter equipped with a thermal printer which uses a print head adapted to print utilizing heat. The print head is movable between a printing position in which the print head is in pressed contact with a recording medium via a print ribbon, and a non-printing or release position in which the print head is spaced apart from the recording medium. Usually, the print head is mounted on a carriage or similar carrier, so that printing is effected while the print head is moved with the carrier along a line of printing.

The printing apparatus described above is commonly arranged such that an active portion of the print ribbon is supplied from a ribbon supply section (such as a supply spool of a ribbon cassette) and is fed past the print head. The used portion of the print ribbon which has passed the print head is moved into a ribbon take-up section (such as a take-up spool of the cassette) by suitable ribbon feeding means such as a ribbon take-up device. Thus, the print head is always loaded with an unused portion of the print ribbon.

The ribbon feeding means is operable while the print head is placed in its printing position. In this condition, the print ribbon is fed by a distance corresponding to a distance of movement of the print head. While the print head is placed in the release position, however, the ribbon feeding means is not operable. For example, the print head is moved to the release position when a carriage return takes place, with the print head returned to the beginning of a new print line, so that the print ribbon is not fed during a non-printing return movement of the print head.

Generally, the print head may be fed without a printing action, when a space key or other space commanding member is operated. When such a space commanding member is momentarily operated, the print head is fed by a distance equal to the selected printing pitch. Some printing apparatus have a so-called self-repeat spacing function wherein the print head is fed continuously by a distance equal to a multiple of the printing pitch, if the space commanding member is continuously operated or held in its operated position for a desired length of time corresponding to a desired distance of spacing.

In a conventional printing apparatus, the print head is moved to provide a spacing while the print head remains in its printing position, if a space commanding member is momentarily or continuously operated when the print head is in the printing position.

In the above arrangement wherein a spacing movement of the print head is effected while the print head remains in the printing position (in pressed contact with the print ribbon), the movement of the print head activates the ribbon feeding means to feed the print ribbon, and therefore causes waste of an unused length of the ribbon. To avoid this inconvenience, there has been proposed a technique to bring the print head to its release position prior to effecting a spacing movement of the print head.

However, the proposed arrangement causes another problem. That is, required overall printing time for a specific print job is increased due to extra non-printing time that must be spent in moving the print head to the release position and returning the same to the printing position each time a space is provided between successive English words, for example.

It has been also proposed to bring the print head to the release position by a suitable head release mechanism if a space key is operated two or more times. In this case, the print head is not moved to the release position when the space key is operated once to provide a single space. Consequently, the foregoing proposal is free from the above problem of extra non-printing time due to the movements of the print head between the printing and release positions. However, if the space key is operated two times to provide two spaces between sentences, the above problem is encountered. The problem is becoming more and more important, due to the recent tendency in thermal printer technology of using a motor as a drive source for the head release mechanism, in place of a conventionally used solenoid, in an attempt to reduce operating noises of the head release mechanism for moving the print head between the printing and release positions. Namely, the head release mechanism driven by a motor requires a longer operating time than the conventional solenoid-operated mechanism.

SUMMARY OF THE INVENTION

Accordingly, it is an object of the present invention to provide a printing apparatus wherein printing is effected with a print head fed in pressed contact with a print ribbon, which apparatus overcomes the conventionally experienced problems discussed above.

The above object can be attained according to the principle of the present invention, which provides a printing apparatus comprising: (a) a print head movable between a printing position thereof in which the print head is in pressed contact with a recording medium via a print ribbon, and a release position thereof in which the print head is spaced apart from the recording medium; (b) ribbon feeding means including a ribbon supply section and a ribbon take-up section, the ribbon feeding means being operable while the print head is placed in the printing position, for feeding an active portion of the print ribbon past the print head from the ribbon supply section toward the ribbon take-up section, the ribbon feeding means being inoperable while the print head is placed in the release position; (c) data input means including space commanding means for feeding the print head by a distance equal to a printing pitch, without a printing action, when the space commanding means is momentarily operated, and for feeding the print head continuously by a distance equal to a multiple of the printing pitch, without the printing action, while the space commanding means is held operated; (d) head release means for moving the print head from the printing position to the release position; and (e) head-release control means for inhibiting the head release means from operating to move the print head to the release position if the space commanding means is momentarily operated, and for commanding the head release means to operate to move the print head to the release position to thereby disable the ribbon feeding means, if the space commanding means is operated continuously.

In the printing apparatus of the present invention constructed as described above, the print head is not moved to the release position when the space commanding means is momentarily operated, even two or more times successively to provide two or more successive spaces each corresponding to the printing pitch. In this case, the print head is fed in pressed contact with the recording medium via the print ribbon. When the operator wishes to provide a spacing over a comparatively large distance, the operator keeps the space commanding means in the operated position for an appropriate length of time. In this case, the head release means is operated to move the print head to the release position, whereby the print ribbon is not fed while the print head is fed by a distance equal to a multiple of the printing pitch which is determined by the time during which the space commanding means is continuously operated.

According to the present invention as described above, the print ribbon is not fed during a continuous spacing movement of the print head, and a waste of the print ribbon is avoided. Further, the printing efficiency is not deteriorated by movements of the print head between its printing and release positions when the space commanding means is momentarily operated, either once or two or more times, so as to provide successive spaces. Thus, the present printing apparatus minimizes a required overall printing time, and useless consumption of the print ribbon. Namely, the present apparatus provides a compromise between the printing efficiency and the ribbon consumption economy.

In one form of the printing apparatus of the present invention, the space commanding means includes a space key which commands the print head to be fed by the distance equal to the printing pitch if the space key is momentarily held in an operated position for less than a predetermined operating time, and which commands the print head to be fed continuously by the distance equal to the multiple of the printing pitch if the space key is continuously held in the operated position for more than the predetermined operating time. In this case, the head-release control means comprises: memory means; memory control means responsive to an operation of the space key, for storing a space code in the memory means, and storing a self-repeat code in the memory means if the operation of the space key continues for more than the predetermined time; and executing means for sequentially executing codes stored in the memory means, the executing means executing the space code without commanding the head release means to move the print head to the release position, and executing the self-repeat code while commanding the head release means to move the print head to the release position.

According to one arrangement of the above form of the invention, the memory means stores character codes for printing characters, as well as the space code and the self-repeat code, and the executing means of the head-release control means commands the head release means to move the print head to the release position if none of the character codes, the space code and the self-repeat code are stored in the memory means for more than a predetermined non-operating time.

According to another arrangement of the same form of the invention, the executing means is inoperable to command the head release means to move the print head to the printing position if the print head has been placed in the release position when the space code is executed by the executing means.

In another form of the present invention, the space commanding means comprises a space key, and a specific key, and the head-release control means is inoperable to command the head release means to move the print head to the release position if the space key is operated alone, and operable to command the head release means to move the print head to the release position if the space key is continuously operated together with the specific key.

BRIEF DESCRIPTION OF THE DRAWINGS

The above and other objects, features and advantages of the present invention will be better understood by reading the following detailed description of presently preferred embodiments of the invention, when considered in connection with the accompanying drawings, in which.

DETAILED DESCRIPTION OF THE PREFERRED EMBODIMENTS

Figure 1:
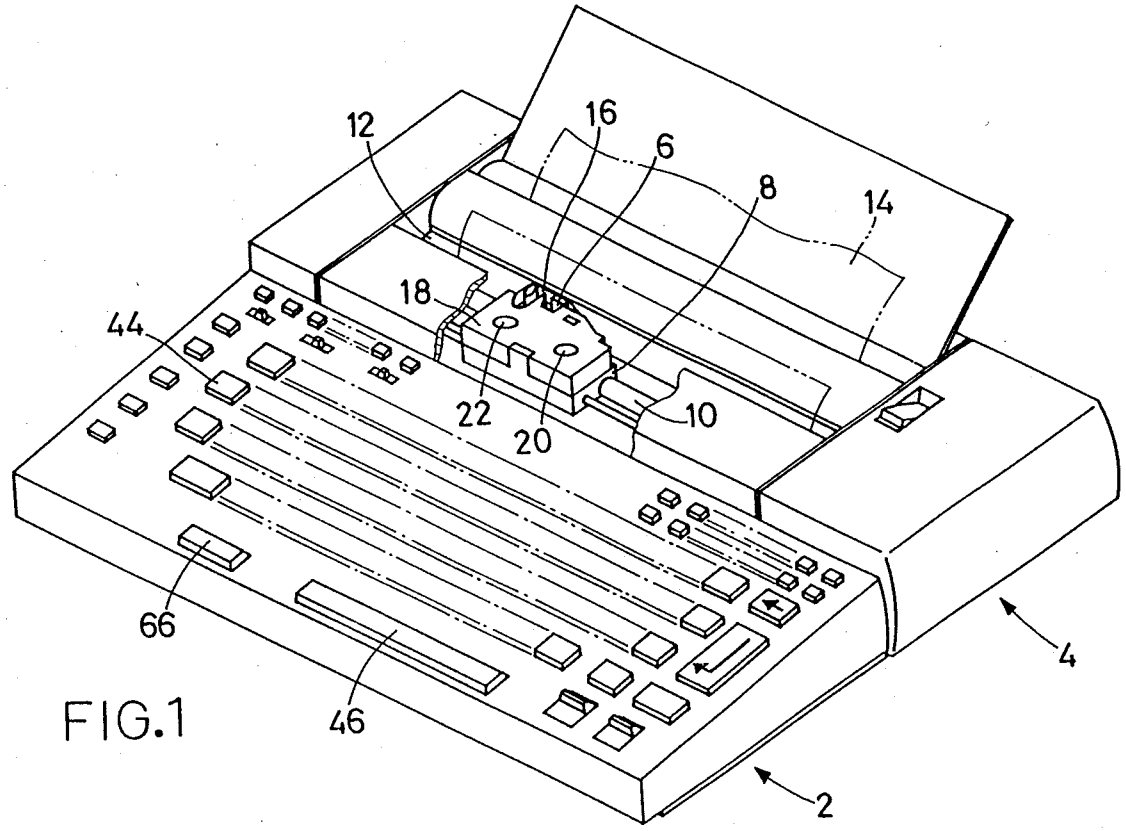
FIG. 1 is a perspective view of an electronic typewriter incorporating one embodiment of a printing apparatus of the present invention.

Referring first to FIG. 1, a printing apparatus in the form of an electronic typewriter has data input means in the form of a keyboard 2, and a printer 4 adapted to effect a printing operation according to printing data entered through the keyboard 2.

Figure 2:
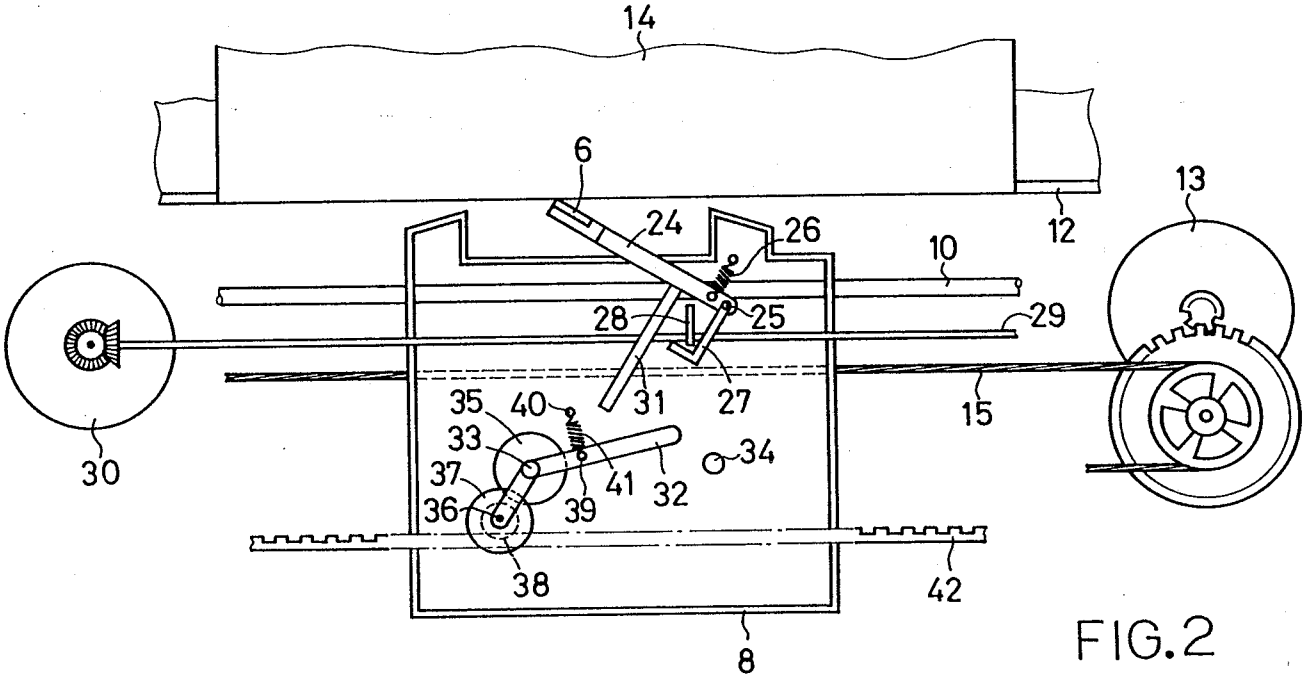
FIG. 2 is a fragmentary plan view of the printing apparatus of the typewriter of FIG. 1, illustrating the internal mechanism of a carriage when placed in the printing position.

The printer 4 is a thermal printer having a thermal print head 6 which is mounted on a carriage 8. The carriage 8 is slidably supported by a guide bar 10 which extends parallel to an elongate platen 12. As shown in FIG. 2, the carriage 8 is operatively connected to a drive motor 13 through a drive wire 15. The platen 12 supports a recording medium 14 in a direction perpendicular to a direction of movement of the carriage 8. As described later, the thermal print head 6 is supported pivotally about a vertical axis secured on the carriage 8, so that the print head 6 is movable between a printing position in which the print head 6 is in pressed contact with the surface of the recording medium 14 via a print ribbon 16, and a release or non-printing position in which the print head is spaced apart from the recording medium 14. The print ribbon 16 is accommodated in a ribbon cassette 18 which is removably mounted on the carriage. An active portion of the print ribbon 16 is supplied from a supply section of the cassette 18 in the form of a supply spool 20, and is fed past the print head 6. The used length of the ribbon is accommodated in a take-up section of the cassette 18, i.e., rewound on a take-up spool 22 due to rotation of the take-up spool.

Figure 3:
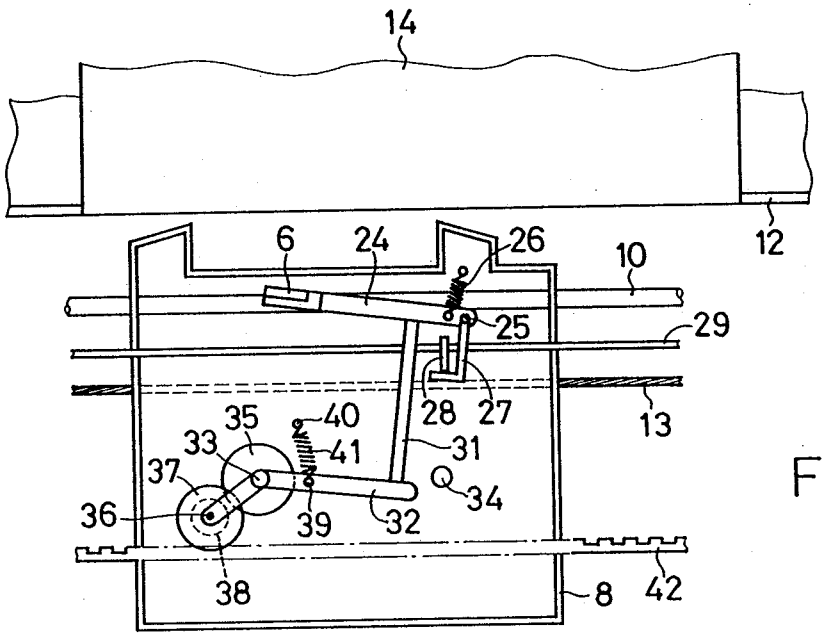
FIG. 3 is a view corresponding to that of FIG. 2, illustrating the internal mechanism of the carriage when placed in the release or non-printing position.

Referring next to FIGS. 2 and 3, the internal structure of the carriage 8 will be described.

At a portion of the carriage 8 near the platen 12, there is supported a support arm 24 such that the arm 24 is pivotable at its one end about a support shaft 25 fixed to the carriage 8. This support arm 24 has the thermal print head 6 fixed thereto at its other or free end. The print head 6 has heat generating elements which are selectively energized according to the printing data, to fuse the corresponding portions of the print ribbon 16 and transferring the fused ink material to the recording medium 14, thereby permitting dot-matrix printing of characters or any other images on the medium 14. The support arm 24 supporting the print head 6 is biased in a clockwise direction (as seen in FIG. 2) about the support shaft 25, by a coil spring 26, which is connected to the arm 24 and the carriage 8. Thus, the print head 6 is normally placed in its printing position of FIG. 2, in which the print head 6 is held in pressed contact with the medium 14 via the print ribbon 16.

The support arm 24 has an L-shaped cam follower 27 secured to the fixed end, at which the arm 24 is pivotally supported by the shaft 25. The cam follower 27 extends in a direction away from the platen 12, so that the cam follower 27 is engageable with an elliptical peripheral cam 28 slidably supported on a cam shaft 29. As shown in FIG. 2, the cam shaft 29 is coupled to a drive motor 30, whereby the cam 28 is rotated by the motor 30 via the cam shaft 29. The cam 28 is sandwiched by a fork consisting of a pair of tabs (not shown) formed on the carriage 8, so that the cam 28 is slidablY moved on the cam shaft 29 when the carriage 8 is moved along the platen 12. With rotation of the peripheral cam 28 which is engageable with the cam follower 27, the support arm 24 is pivoted between its printing position of FIG. 2 and its non-printing or release position of FIG. 3. In the printing position, the print head 6 is in pressed contact with the platen 12 (recording medium 14) under the biasing action of the coil spring 26. In the release position, the print head 6 is located away from the platen 2 against the biasing force of the spring 26. As described later, the elements 22, 26, 27, 29 and 28 constitute a mechanism for operating the support arm 24 between its printing and non-printing position, i.e., head release means for moving the print head 6 between the printing position and the release position.

The support arm 24 further has an actuator bar 31 fixed thereto at a point between the L-shaped cam follower 27 and the print head 6, such that the actuator bar 31 may function as a linkage for imparting a pivotal motion of the support arm 24 to a pivotable lever, when the support arm 24 is moved to its non-printing position of FIG. 3.

The carriage 8 incorporates a power transmitting mechanism which includes a take-up spool shaft 33 for rotating the take-up spool 22. The take-up spool shaft 33 is rotatably supported on the carriage 8, and extends upright for engagement with the take-up spool 22 (FIG. 1) at its upper end. Similarly, a supply spool shaft 34 is rotatably supported to the right of the take-up spool shaft 33 (as seen in FIG. 2), for rotatably supporting the supply spool 20 (FIG. 1). The power transmitting system further includes a drive gear 35 fixed to an intermediate portion of the take-up spool shaft 33, and the above-indicated pivotable lever 32 which is supported pivotally by the take-up spool shaft 33. The pivotable lever 32 is bent a suitable angle at its axis of pivot (axis of the take-up spool shaft 33). Namely, the pivotable lever 32 consists of a first long arm and a second short arm which extend from the take-up spool shaft 33, so as to form a given angle. The second arm of the pivotable lever 32 has a shaft 36 fixed thereto at its end, such that the shaft 36 extends downwardly from the lower surface of the second arm. This shaft 36 rotatably supports a second gear which consists of a large-diameter intermediate gear 37 engaging the first or drive gear 35, and a small-diameter gear in the form of a pinion 38 formed integrally with the large-diameter intermediate gear 37. The pivotable lever 32 has a pin 39 fixed thereto, while the carriage 8 has another pin 40 fixed thereto. A coil spring 41 is connected to these pins 39, 40, so that the pivotable lever 32 is biased by the coil spring 41 in the counterclockwise direction (In FIG. 2) about the take-up spool shaft 33. Thus, the pivotable lever 32 is normally placed in its operative position of FIG. 2 in which the pinion 38 engages a stationary rack 42 secured to the frame of the printer 4, so as to extend in the longitudinal direction of the platen 12.

In the above arrangement, the take-up spool 22 is rotated through the pinion 38, gears 37, 35 and take-up spool shaft 33, when the carriage 8 is moved by the drive motor 13 via the drive wire 15, while the support arm 24 and the print head 6 are placed in the printing position of FIG. 2, in which the pinion 38 is held in engagement with the rack 42. When the support arm 24 is pivoted to the non-printing position by rotation of the cam 28 by the drive motor 30, i.e., when the print head 6 is moved to the released position of FIG. 3, the pivotable lever 32 is pivoted by the actuator bar 31 in the clockwise direction (in FIG. 2), whereby the pinion 38 is disengaged from the rack 42. As a result, the movement of the carriage 8 will not cause a rotating motion of the take-up spool 22. Namely, the print ribbon 16 is fed only while the print head 6 is placed in its printing position. Thus, the ribbon feeding means of the instant printer 4 is constructed.

The keyboard 2 has character keys such as alphabet keys 44, and function keys such as a space key 46 (also called space bar). The space key 46 functions as space commanding means for feeding the print head 6 (carriage 8) by a distance equal to a selected printing pitch of the printer 4, without a printing action, when the space key 46 is momentarily operated, and for feeding the print head 6 continuously by a distance equal to a multiple of the printing pitch, without a printing action, while the space key 46 is continuously held in its operated position.

Figure 4:
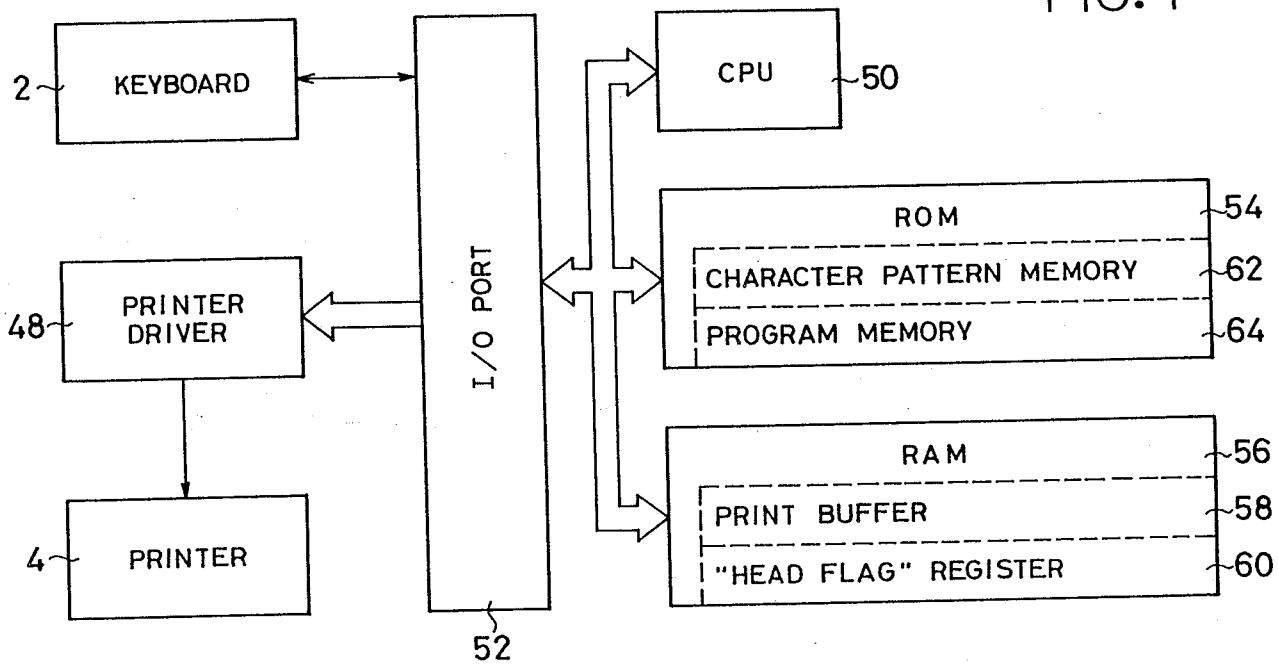
FIG. 4 is a block diagram showing a control system of the typewriter.

Referring next to FIG. 4, there is illustrated the control system for the instant typewriter.

The printer 4 is controlled bY a printer driver 48. This printer driver 48 and the keyboard 2 are connected to a central processing unit (CPU) 50 via an I/O port 52. The CPU 50 is connected to a read-only memory (ROM) and a random-access memory (RAM) 56.

The RAM 54 has various registers and counters, which include a print buffer 58 for temporarily storing key data entered through the keyboard 2, and a HEAD FLAG register 60 for setting a PRINT POSITION flag which indicates that the thermal print head 6 is placed in its printing position. The print buffer 58 is adapted to sequentially store a space code indicative of an operation of the space key 46, as well as the character codes indicative of the operations of the character keys on the keyboard 2.

The print buffer 58 consists of a recirculating register in which memory locations are used for writing and reading data, as in a closed loop. The buffer register 58 has a WRITER pointer which indicates a position in which the keyed-in code is stored, and a READ pointer which indicates a position from which the stored code is read out for printing. These pointers are shifted to indicate the data storage or read-out position each time a data storage or read-out operation is executed.

The ROM 54 has a character pattern memory 62 which stores character patterns to be printed according to the character codes which are read out from the print buffer 58. The ROM 54 further has a program memory 64 which stores various control programs for controlling various operations of the typewriter. The control program associated with spacing movements of the print head 6 and the related movement of the print head to its release position is illustrated in the flow chart of FIG. 5.

Initially, the control flow goes to step Sl in which the CPU 50 refers to the print buffer 58, according to the READ pointer, and reads out the appropriate data from the position indicated by the READ pointer. In step S2, the CPU 50 determines whether any keyed-in data is stored in the appropriate position of the print buffer 58. If any keyed-in data is stored, the control flow goes to step S3 to determine whether the keyed-in data is a character code to be printed. If, for example, the keyed-in data is a character code data indicative of an alphabet key, an affirmative decision (YES) is obtained in step S3, and step S3 is followed by step S10 to determine whether the print head 6 is placed in its printing position. If the print head 6 is not placed in its printing position, the control flow goes to step Sll in which the print head 6 is moved from the release position to the printing position. Then, the control flow goes further to step S12 in which the "PRINT POSITION" flag of the HEAD FLAG register 60 is set. Step S12 is followed by step S14 in which a character corresponding to the appropriate character code is printed. For example, character "T" is printed, as indicated at the leftmost position in FIG. 6. If the determination in step S10 reveals that the print head 6 is already placed in the printing position, step S10 is directly followed by step S14, with steps Sll and S12 being skipped.

If the CPU 50 determines in step S3 that the keyed-in data stored in the appropriate position of the print buffer 58 is not character data, step S3 is followed by step S4 to determine whether the keyed-in data is a space code or not. If a negative decision (NO) is obtained in step S4, the control flow goes to step S18 in which other function key code such as a back space code, or a line feed code is processed to perform the appropriate function. If an affirmative decision (YES) is obtained in step S4, the control flow goes to step S5 to determine whether the print head 6 is placed in the printing position.

Figure 7:
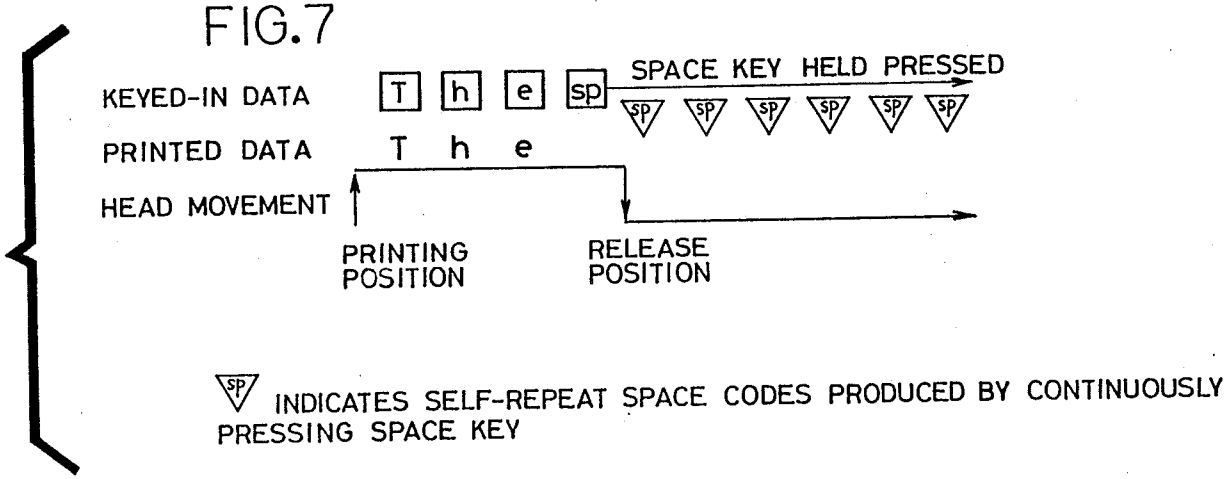

If the determination in step S5 reveals that the print head 6 is in the printing position, that is, if the "PRINT POSITION" flag of the HEAD FLAG register 60 is in the set state, step S5 is followed by step S6 to determine whether the space key 46 is continuously operated, i.e., whether a self-repeat code is generated or not. When the space key 46 is momentarily or temporarily operated, one space code is stored in the print buffer 58. However, if the space key 46 is held in the pressed or operated position for more than a predetermined time, a self-repeat code follows the space code already stored in the print buffer 58. Each time the predetermined operating time has passed, self-repeat codes are successively stored in the print buffer 58, as indicated in FIG. 7. Therefore, the CPU 50 makes the determination in step S6, by checking if the appropriate code in the print buffer 58 is a space code or a self-repeat code.

Figure 6:
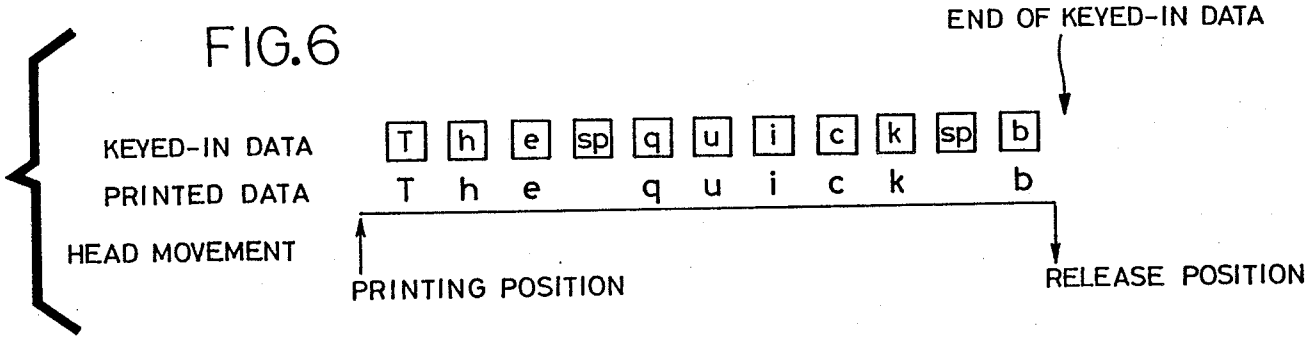
FIGS. 6 and 7 are illustrations showing different examples of operations relating to spacing movements of the carriage.

If a negative decision (NO) is obtained in step S6, that is, if the space key 46 is momentarily, step S6 is followed by step S13 wherein the space code is converted into a carriage movement code. In other words, the space code is processed into a carriage movement code, which is treated as data similar to character codes to be printed. In the following step S14, the carriage movement code is executed to move the carriage by a distance equal to the selected printing pitch (i.e., one-character distance), without energizing the heat generating elements of the print head 6, i.e., without a printing action. However, the carriage 8 is moved by the one-character distance, with the print head 6 held in the printing position in which the head 6 is in pressed contact with the recording medium 14. In this manner, a space corresponding to the printing pitch is formed between two adjacent English words, as indicated in FIG. 6.

In the above case, the print ribbon 16 is wound on the take-up spool 22, since the carriage 8 is moved while the print head 6 remains in the printing position. However, the wound unused length of the ribbon 16 corresponding to the one-character distance moved by the spacing movement of the carriage 8 is considered a short distance as compared with a total length of the ribbon. That is, a loss of the print ribbon 16 due to the winding of this short unused length does not significantly reduce the printing economy in terms of the cost of the ribbon 16. Instead, the instant arrangement contributes to reduction in the printing time, since a movement of the carriage 8 to create a single space is not accompanied with a movement of the print head 6 to its release position.

If the determination in step S6 reveals that the space key 46 is continuously held in the pressed position for a predetermined time, that is, if a self-repeat code is detected following a space code in the print buffer 58, the control flow goes to step S7 wherein the motor 30 is operated to move the print head 6 to its release position. Step S7 is followed by step S8 in which the "PRINT POSITION" flag of the HEAD FLAG register 60 is reset.

Then, the control flow goes to step S9 in which the carriage 8 is moved by the one-character distance (equal to the printing pitch). In this step S9, the self-repeat code is treated as a function code, contrary to the space code which is processed in step S13 as described above. As long as the space key 46 is held pressed, steps S1–S5, and step S9 are repeatedly executed, with steps S7 and S8 being skipped, whereby the carriage 8 and the print head 6 are continuously moved by a distance equal to a multiple of the printing pitch. As a result, a plurality of spaces are successively formed over the distance of movement of the carriage 8, as indicated in FIG. 7.

As described above, if successive self-repeat codes follows a space code as indicated in FIG. 7, the print head 6 is moved from its printing position to its release position so that the ribbon feeding means is disabled with the pinion 38 disengaged from the rack 42. Accordingly, a considerable length of the print ribbon 16 will not be wound in an unused state on the take-up spool 22.

It follows from FIG. 7 that the print head 6 is moved to its release position only after the carriage 8 is moved by the one-character distance with the print head 6 in the printing position, in the case the space key 46 is continuously operated. Stated differently, when the space key 46 is operated for the first time, the corresponding space code is stored in the print buffer 58. With the space key 46 kept pressed, a self-repeat code or codes is/are stored following the already stored space code. The CPU 50 detects the self-repeat code or codes and executes steps S1–S9, after steps S13 and S14 are executed to provide the first space. Thus, a continuous operation of the space key 46 results in a first spacing movement of the print head 6 along the platen 12 by one-character distance, a movement of the print head 6 to its release position, and a following spacing movement of the print head 6 in a continuous manner by a distance equal to a multiple of the printing pitch which corresponds to the number of the self-repeat code following the first space code.

If a keying-in operation through the keyboard 2 is terminated, or interrupted for more than a predetermined non-operating time, during a printing operation as indicated in FIG. 6, no keyed-in codes are stored in the position of the print buffer 58 designated by the READ pointer. In this case, therefore, a negative decision (NO) is made in step S2, and the control flow goes to step S15 to determine whether the print head 6 is placed in the printing position or not. If the print head 6 is in the printing position, step S16 is executed to move the print head 6 to its release position, and then step S17 is executed to reset the "PRINT POSITION" flag of the HEAD FLAG register 60. Thus, the operation involved is temporarily terminated. Thereafter, steps S1, S2 and S15 are repeatedly executed.

In the case where the space key 46 is momentarily or continuously operated with the print head 6 in the release position, a negative decision (NO) is obtained in step S5, the control flow goes to step S9, whereby the carriage 8 is moved by ore-character distance with the print head 6 placed in the release position.

In the illustrated embodiment, a continuous operation of the space key 46 first causes a spacing movement of the carriage 8 with the print head 6 maintained in the printing position, and then a continuous spacing movement corresponding to self-repeat codes. However, it is possible to produce a self-repeat space code when the space key 46 is operated together with a suitable key such as a repeat key 66 as indicated in FIG. 1. In this case, the print head 6 is moved to the release position when the space key 46 and the repeat key 66 are concurrently operated.

Figure 5A:
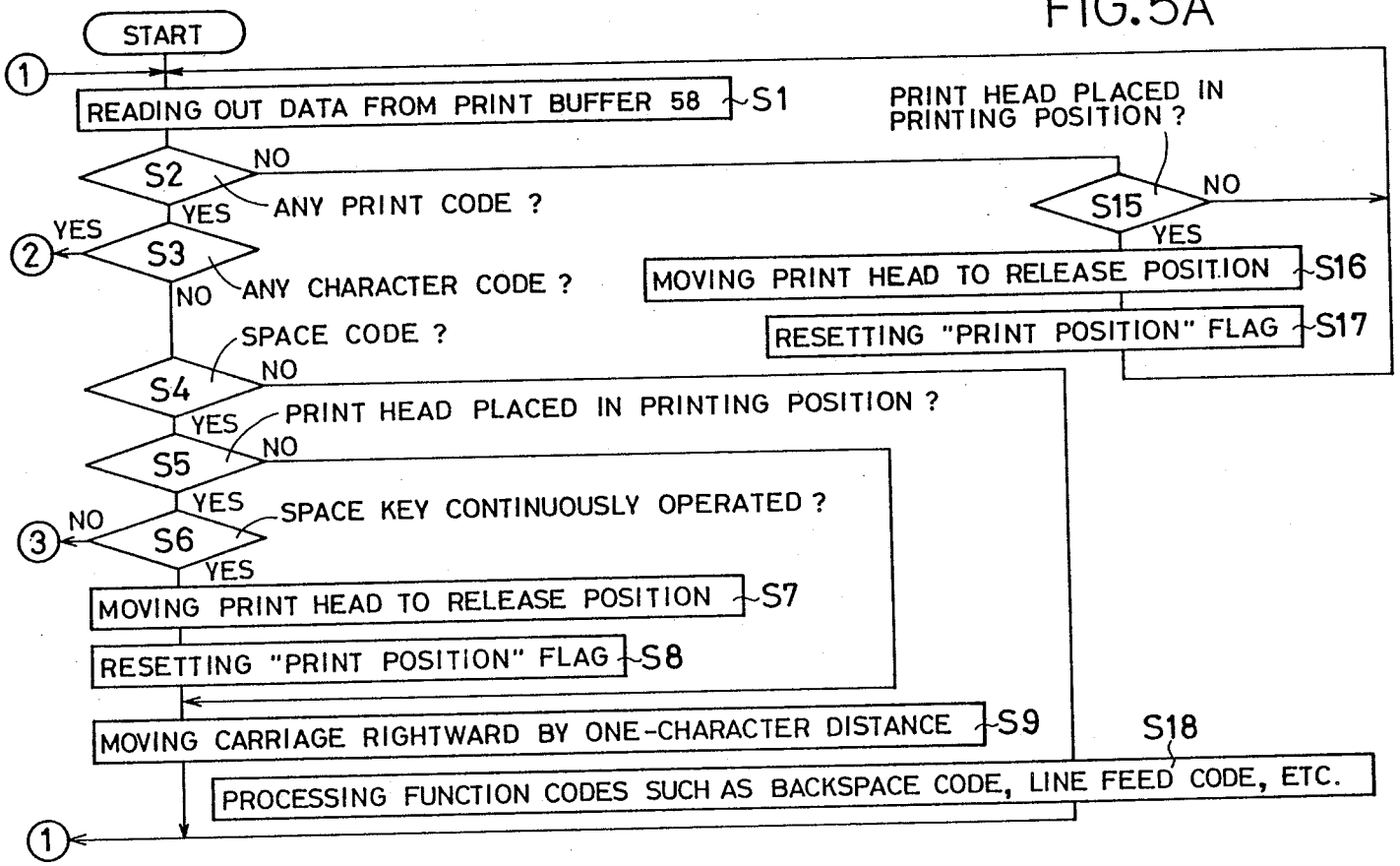
FIG. 5 is a flow chart illustrating a control program stored in a read-only memory, which is associated with the principle of the present invention.
Figure 5B:
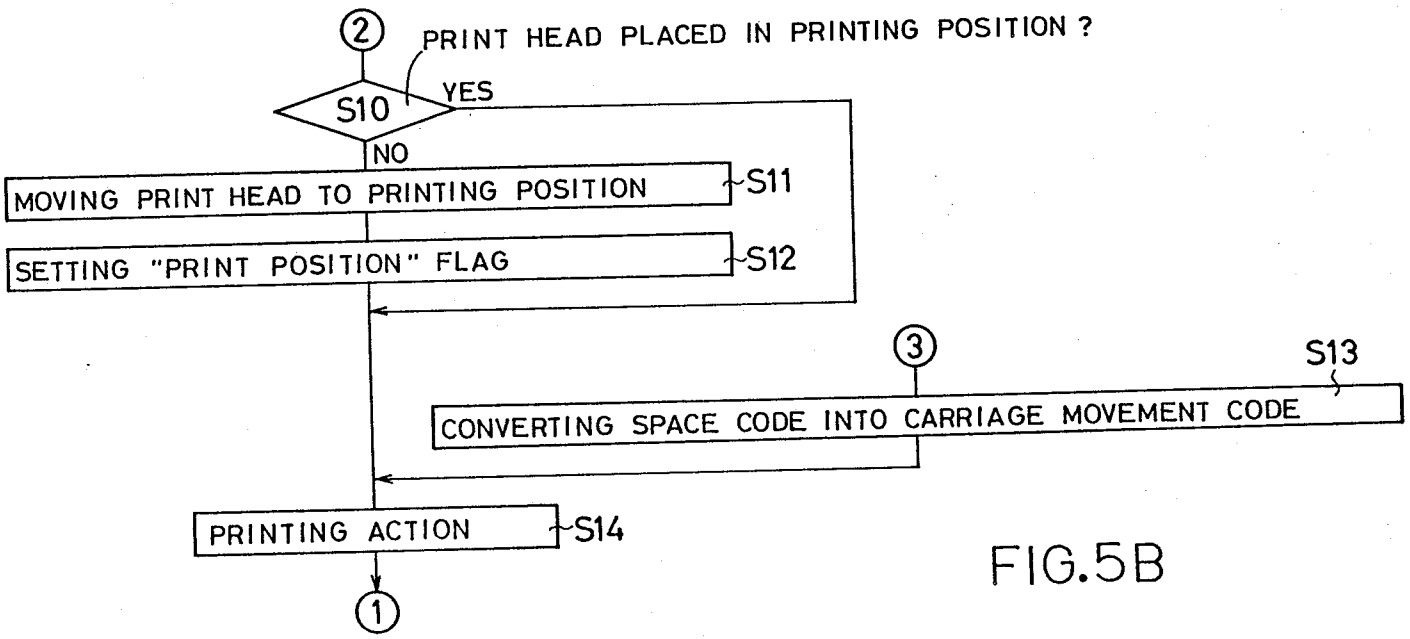
Figure 8:
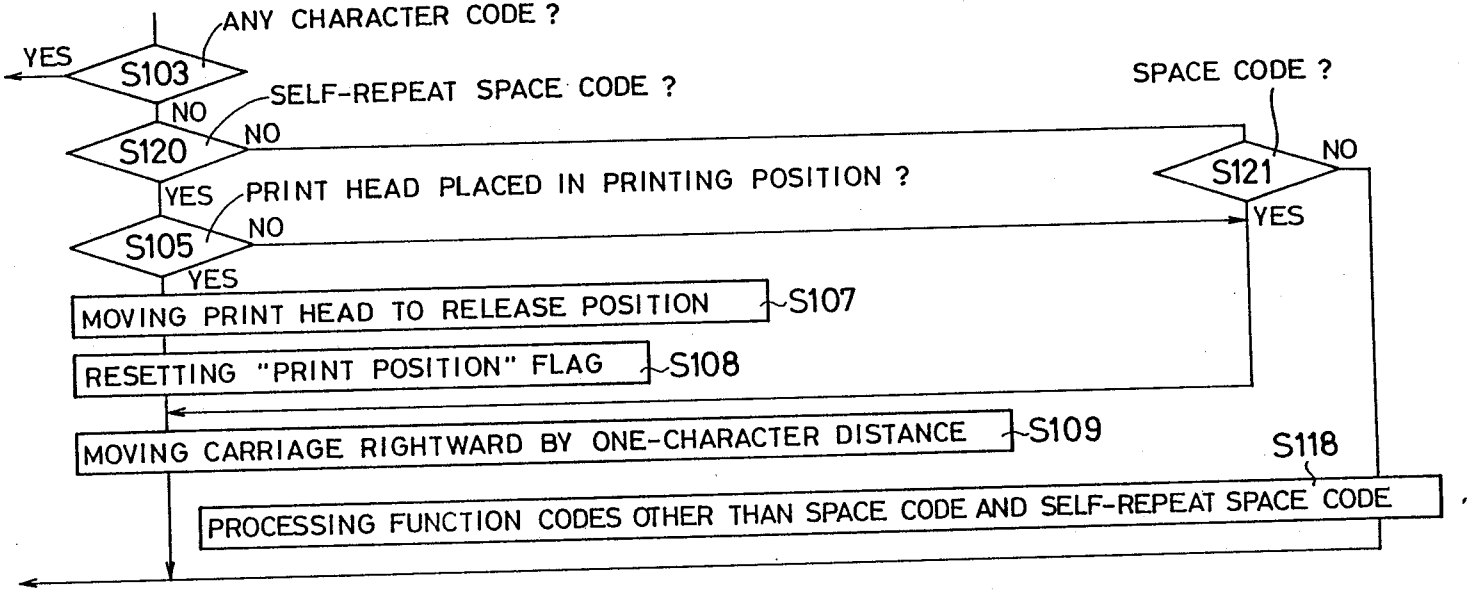
FIG. 8 is a flow chart illustrating a modified embodiment of the invention.

An operation according to the above modified embodiment of the invention is illustrated in the flow chart of FIG. 8, wherein step S103 corresponds to step S3 of FIG. 5. Step S103 is followed by step S120 to determine whether the keyed-in code is a self-repeat space code or not. If an affirmative decision YES) is obtained in step S120, the control flow goes to step S105 and subsequent steps S107–S109, whereby the print head 6 is moved to the release position and then the carriage 8 is moved to provide a single space. If a negative decision is obtained in step S120, the control flow goes to step S121 to determine whether the keyed-in code is a space code generated by an operation of the space key 46 alone. If an affirmative decision is obtained in step S121, step S121 is followed by step S109 in which the carriage 8 is moved rightward to provide a space with the print head 6 placed in the printing position. It is noted that the steps of the flow chart of FIG. 8, except for steps S120 and S121, are similar to the corresponding steps of FIG. 5 whose numbers are smaller by 100 than the step numbers used in FIG. 8. In the interest of brevity, the corresponding steps of FIG. 8 are not described herein.

While the principle of the present invention is suitably applicable to a typewriter having a thermal print head as described and illustrated above, it will be understood that the present invention is equally applicable to other types of printing apparatus in which a print ribbon is fed with the print head placed in the printing position, but not fed while the print head is in the release or non-printing position.

It will also be understood that the present invention may be embodied with various other changes, modifications and improvements, which may occur to those skilled in the art, without departing from the spirit and scope of the invention defined in the following claims.

What is claimed is:

1. A printing apparatus comprising:

a print head movable between a printing position thereof in which the print head is in pressed contact with a recording medium via a print ribbon, and a release position thereof in which the print head is spaced apart from the recording medium;

ribbon feeding means including a ribbon supply section and a ribbon take-up section, said ribbon feeding means being operable while said print head is placed in said printing position, for feeding an active portion of said print ribbon past said print head from said ribbon supply section toward said ribbon take-up section, said ribbon feeding means being inoperable while said spring head is placed in said release position;

data input means including a space key for feeding said print head by a distance equal to a printing pitch, without a printing action, when said space key is held in an operated position for less than a predetermined operating time, and for feeding said print head continuously by a distance equal to a multiple of said printing pitch, without the printing action, while said space key is held in said operated position for more than said predetermined operating time;

head release means for moving said print head from said printing position to said release position; and head-release control means for inhibiting said head release means from operating to move said print head to said release position if said space key is held in said operated position for less than said predetermined operating time, and for commanding said head release means to operate to move said print head to said release position to thereby disable said ribbon feeding means, if said space key is held in said operated position for more than said predetermined operating time wherein said head-release control means comprises:

a print buffer for temporarily storing data as the data is entered through said data input means, and outputting said data in the order of entry thereto;

memory control means responsive to an operation of said space key, for storing a space code in said print buffer, and storing a self-repeat code in said print buffer if said operation of the space key continues for more than said predetermined time; and executing means for sequentially executing codes stored in said print buffer, said executing means executing said space code without commanding said head release means to move said print head to said release position, and executing said self-repeat code while commanding said head release means to move said print head to said release position.

2. A printing apparatus according to claim 1, wherein said print buffer stores character codes for printing characters, as well as said space code and said self-repeat code, and said executing means of said head-release control means commands said head release means to move said print head to said release position if none of said character codes, said space code and said self-repeat code are stored in said print buffer for more than a predetermined non-operating time.

3. A printing apparatus according to claim 1, wherein said executing means is inoperable to command said head release means to move said print head to said printing position if said print head has been placed in said release position when said space code is executed by said executing means.

4. A printing apparatus comprising:

a print head movable between a printing position thereof in which the print head is in pressed contact with a recording medium via a print ribbon, and a release position thereof in which the print head is spaced apart from the recording medium;

ribbon feeding means including a ribbon supply section and a ribbon take-up section, said ribbon feeding means being operable while said print head is placed in said printing position, for feeding an active portion of said print ribbon past said print head from said ribbon supply section toward said ribbon take-up section, said ribbon feeding means being inoperable while said print head is placed in said release position;

data input means including a space key for feeding said print head by a distance equal to a printing pitch, without a printing action, when said space key is operated alone, and a specific key which is operated together with said space key, for feeding said print head continuously by a distance equal to a multiple of said printing pitch, without the printing action, while said space key and said specific key are operated together;

head release means for moving said print head from said printing position to said release position; and head-release control means for inhibiting said head release means from operating to move said print head to said release position if said space key is operated alone, and for commanding said head release means to operate to move said print head to said release position to thereby disable said ribbon feeding means, if said space key and said specific key are operated together.

* * * * *